US010875324B2

(12) United States Patent
Yasumoto et al.

(10) Patent No.: US 10,875,324 B2
(45) Date of Patent: Dec. 29, 2020

(54) FINGER NAIL PRINTER

(71) Applicant: FUNAI ELECTRIC CO., LTD., Osaka (JP)

(72) Inventors: Atsushi Yasumoto, Osaka (JP); Toshiro Tani, Osaka (JP)

(73) Assignee: FUNAI ELECTRIC CO., LTD., Osaka (JP)

( * ) Notice: Subject to any disclaimer, the term of this patent is extended or adjusted under 35 U.S.C. 154(b) by 0 days.

(21) Appl. No.: 16/547,538

(22) Filed: Aug. 21, 2019

(65) Prior Publication Data

US 2020/0062004 A1 Feb. 27, 2020

(30) Foreign Application Priority Data

Aug. 22, 2018 (JP) ..... 2018-155228

(51) Int. Cl.
*B41J 3/407* (2006.01)
*A45D 29/00* (2006.01)

(52) U.S. Cl.
CPC ..... *B41J 3/407* (2013.01); *A45D 29/00* (2013.01); *A45D 2029/005* (2013.01)

(58) Field of Classification Search
CPC ..... B41J 3/4073; B41J 3/407; A45D 29/00; A45D 2029/005
USPC ..... 347/110
See application file for complete search history.

(56) References Cited

U.S. PATENT DOCUMENTS

2012/0147113 A1* 6/2012 Yamasaki ..... A45D 29/00 347/104

FOREIGN PATENT DOCUMENTS

JP 2016150092 8/2016

* cited by examiner

*Primary Examiner* — Huan H Tran
*Assistant Examiner* — Alexander D Shenderov
(74) *Attorney, Agent, or Firm* — JCIPRNET

(57) ABSTRACT

A finger nail printer in which a mounting table can be easily pressed downward against a biasing force even when a biasing member with a large biasing force is used is provided. The finger nail printer includes a placing unit and a positioning unit, the placing unit includes a placing table, an extension portion, and a biasing member, a finger is fixed between the placing table and the positioning unit with the biasing force of the biasing member, and the finger can be inserted and removed as the extension portion is pressed downward against the biasing force of the biasing member.

20 Claims, 10 Drawing Sheets

(FIRST EMBODIMENT)

(SECOND EMBODIMENT)

(THIRD EMBODIMENT)

FINGER NAIL PRINTER

CROSS-REFERENCE TO RELATED APPLICATION

This application claims the priority of Japan patent application serial no. 2018-155228, filed on Aug. 22, 2018. The entirety of the above-mentioned patent application is hereby incorporated by reference herein and made a part of this specification.

BACKGROUND

Technical Field

The present disclosure relates to a finger nail printer, and more particularly to a finger nail printer including a placing table, a biasing member, and a positioning unit.

Description of Related Art

Conventionally, a finger nail printer including a placing table, a biasing member, and a positioning unit is known (see, for example, Japanese Patent Laid-Open No. 2016-150092).

Japanese Patent Laid-Open Publication No. 2016-150092 discloses a fingertip holder for nail art printing including a fingertip pressing member (placing unit), an elastic means (biasing member), and a fingertip restraining member (positioning unit). In Patent Document 1, a fingertip is held between the fingertip pressing member and the fingertip restraining member by using a pressing force of the elastic means. In addition, by pressing the fingertip pressing member against the pressing force, a gap is generated between the fingertip pressing member and the fingertip restraining member, so that the finger can be removed.

In the conventional nail printer including the fingertip holder for nail art printing as described in the above-mentioned Patent Document 1, the finger on which nail printing is performed is fixed due to the pressing force (biasing force) of the elastic means. For this reason, although not described in Patent Document 1, an elastic means having a large pressing force is used in order to stabilize the finger on which nail printing is performed. However, there is a problem that, when removing the finger from the nail printer, it is necessary to press the fingertip pressing member against the pressing force with only one finger on which nail printing is performed, and, if the pressing force (biasing force) of the elastic means (biasing member) is large, it may be difficult for a child or a woman applying a weak force for pressing the fingertip pressing member (placing unit) against the pressing force.

SUMMARY

A finger nail printer according to one aspect of the present disclosure includes a device main body, a placing unit for placing a finger, a positioning unit which is provided above the placing unit to constitute an insertion port for inserting a finger between the placing unit and the positioning unit and to fix the finger, and a printer head which performs printing on a nail of the finger placed on the placing unit, in which the placing unit includes a placing table extending from an inside of the device main body to an outside of the device main body via the insertion port, an extension portion provided to protrude in a lateral direction of the placing table, and a biasing member for biasing the placing table toward the positioning unit, and is configured such that the finger is fixed between the placing table and the positioning unit with a biasing force of the biasing member and the finger is capable of being inserted into or removed from the insertion port as the extension portion is pressed downward against the biasing force of the biasing member.

DESCRIPTION OF EMBODIMENTS

Figure 1:
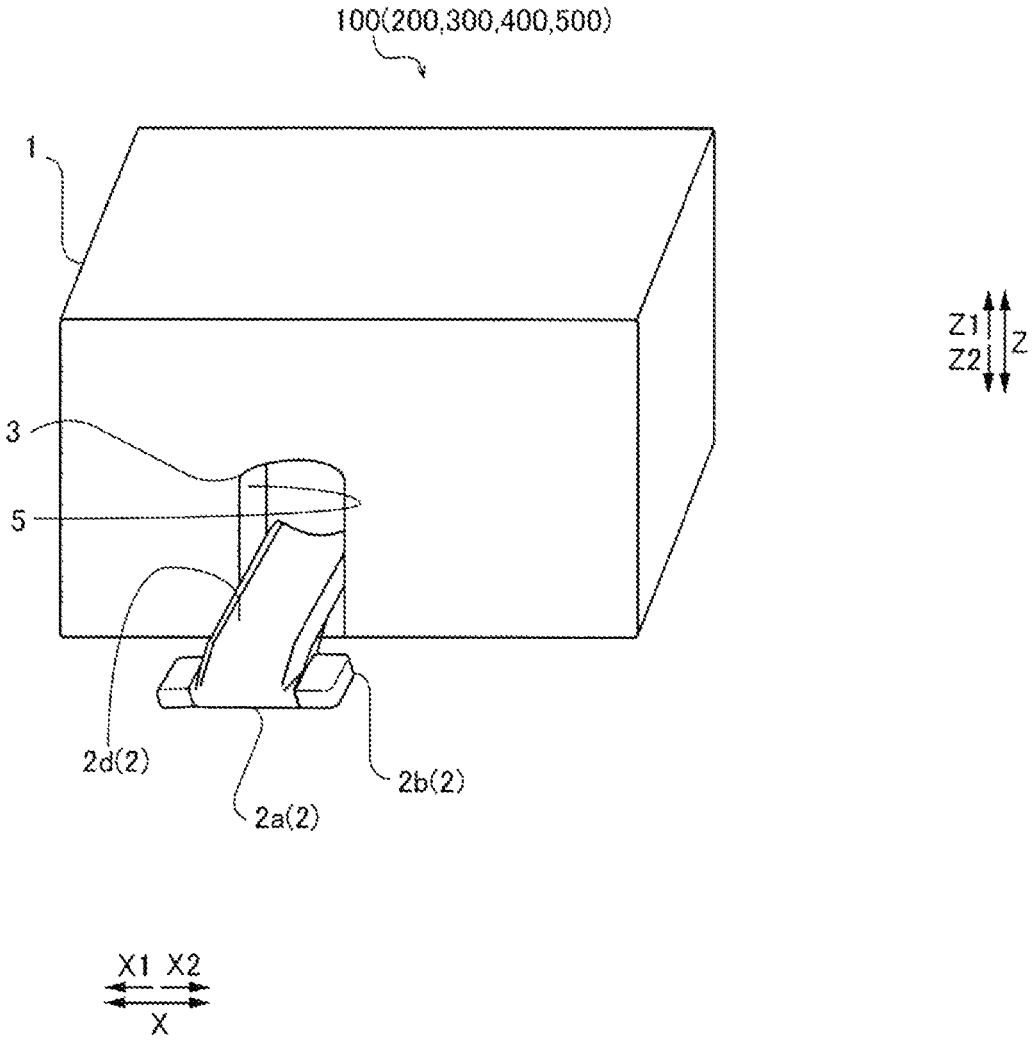
FIG. 1 is a perspective view schematically showing an entire finger nail printer according to first to fifth embodiments of the present disclosure.

The present disclosure has been made to solve the problems as described above, and it is an objective of the present disclosure to provide a finger nail printer in which even a child or a weak woman can easily press a placing unit downward against a biasing force.

The finger nail printer according to the one aspect of the present disclosure includes the placing unit and the positioning unit, the placing unit includes the placing table, the extension portion, and the biasing member, and is configured such that the finger is fixed between the placing table and the positioning unit with the biasing force of the biasing member and the finger can be inserted and removed as the extension portion is pressed downward against the biasing force of the biasing member. According to this configuration, when a user removes the finger fixed between the placing unit and the positioning unit, by pressing the extension portion downward against the biasing force of the biasing member using a finger other than the fixed finger, the state in which the finger is fixed can be released. As a result, even a child or a weak woman can easily press the placing table downward against the biasing force.

In the finger nail printer according to the one aspect of the present disclosure, an upper surface of the extension portion may include a placing region in which the finger at a place other than being inserted into the insertion port can be placed. According to this configuration, since a finger other than the finger inserted into the insertion port can be placed in the placing region, the finger inserted into the insertion port can be supported by another finger placed on the placing region. For this reason, the finger inserted into the insertion port can be stabilized.

In this case, placing regions may be provided on both sides of the placing table. According to this configuration, when a user presses the extension portion against the biasing force of the biasing member using a finger of another hand which is different from the finger fixed to the insertion port, the extension portion provided on a side convenient for the user can be used.

In the extension portion including the placing region according to the one aspect mentioned above, the placing region may have a length in the lateral direction equal to or longer than a length of a placing surface of the placing table in the lateral direction. According to this configuration, one finger can be placed on the placing table, while a plurality of fingers can be placed in the placing region. For this reason, since the extension portion is easily pressed using a plurality of fingers, even a child or a weak woman can easily press the extension portion against the biasing force of the biasing member.

In the finger nail printer according to the one aspect mentioned above, the extension portion may be configured to be extendable and contractible in the lateral direction of the placing table. According to this configuration, by extending and contracting the extension portion in the lateral direction, it is possible to adjust the extension portion to have a length corresponding to a size of the user's finger.

In the finger nail printer according to the one aspect mentioned above, the at least one extension portions may include a plurality of extension portions having different lengths in the lateral direction, and each of the extension portions may be configured to be removably attached to the placing table. According to this configuration, it is possible to select an extension portion having a length corresponding to a size of the user's finger.

In the finger nail printer according to the one aspect mentioned above, an adjustment drive mechanism which adjusts a length of the extension portion by moving the extension portion in the lateral direction may be further provided. According to this configuration, since the adjustment drive mechanism automatically adjusts the length of the extension portion, a user does not have to adjust the length of the extension portion.

In this case, the placing table includes a sensor for detecting information on a size of the finger, and the adjustment drive mechanism is configured to adjust the length of the extension portion on the basis of results detected by the sensor. According to this configuration, since the adjustment drive mechanism automatically adjusts the length of the extension portion on the basis of the information on the size of the finger detected by the sensor, the extension portion can be automatically adjusted to have a length corresponding to the size of the user's finger.

In the finger nail printer according to the one aspect mentioned above, a control unit may be further provided, the placing table may include a sensor for detecting information on a size of the finger, and the control unit may be configured to output information on a length of the extension portion on the basis of results detected by the sensor. According to this configuration, since information on an optimal length of the extension portion is output on the basis of the information on the size of the finger detected by the sensor, the extension portion can be adjusted to be the optimal length corresponding to the size of the user's finger.

In this case, the sensor may be a tactile sensor. According to this configuration, by detecting a pressure or the like, it is possible to accurately acquire information on the size of the finger placed on the placing table.

The finger nail printer according to the one aspect mentioned above may further include an imaging unit disposed above the placing unit, and a control unit which outputs an image of an upper surface imaged by the imaging unit to a display unit or an external terminal, in which the imaging unit images the extension portion in addition to a nail portion of the finger, and the control unit is configured to output information on a length of the extension portion on the basis of results obtained from imaging the extension portion by the imaging unit. According to this configuration, since the display unit or the external terminal displays the information on the length of the extension portion, the user can adjust the extension portion to an optimal length on the basis of the displayed information.

According to the present disclosure, it is possible to provide a finger nail printer in which even a child or a weak woman can easily press a placing table downward against a biasing force.

Hereinafter, embodiments of the present disclosure will be described with reference to the drawings.

First Embodiment

A configuration of a finger nail printer 100 according to a first embodiment of the present disclosure will be described with reference to FIGS. 1 to 5.

Figure 2:
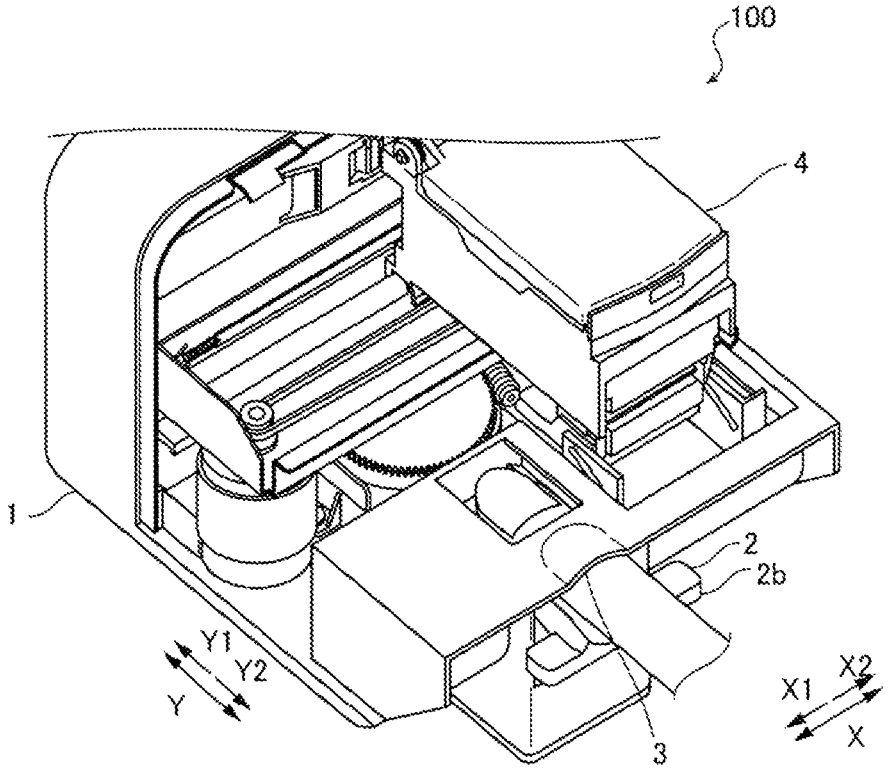
FIG. 2 is a perspective view showing the inside of a fingernail printer according to a first embodiment of the present disclosure.

As shown in FIGS. 1 and 2, the finger nail printer 100 according to the first embodiment of the present disclosure includes a device main body 1, a placing unit 2, a positioning unit 3, and a printer head 4 (see FIG. 2).

The finger nail printer 100 is a device that prints a pattern or the like on a nail of a finger placed in the placing unit 2. The printed pattern may be, for example, a pattern stored inside the device main body 1 or a pattern read in from an external device connected to the device main body 1.

As shown in FIGS. 1 and 2, the device main body 1 has the placing unit 2 and the positioning unit 3. An insertion port 5 for inserting a finger is formed between the placing unit 2 and the positioning unit 3. Here, a direction in which the finger is inserted into the insertion port 5 is referred to as a Y1 direction, a direction in which the finger is pulled out from the insertion port 5 is referred to as a Y2 direction, and the Y1 direction and the Y2 direction are collectively referred to as a Y direction. In addition, a direction orthogonal to the Y direction in a horizontal plane is referred to as an X direction, and a direction orthogonal to the X direction and the Y direction is referred to as a Z direction.

Figure 3:
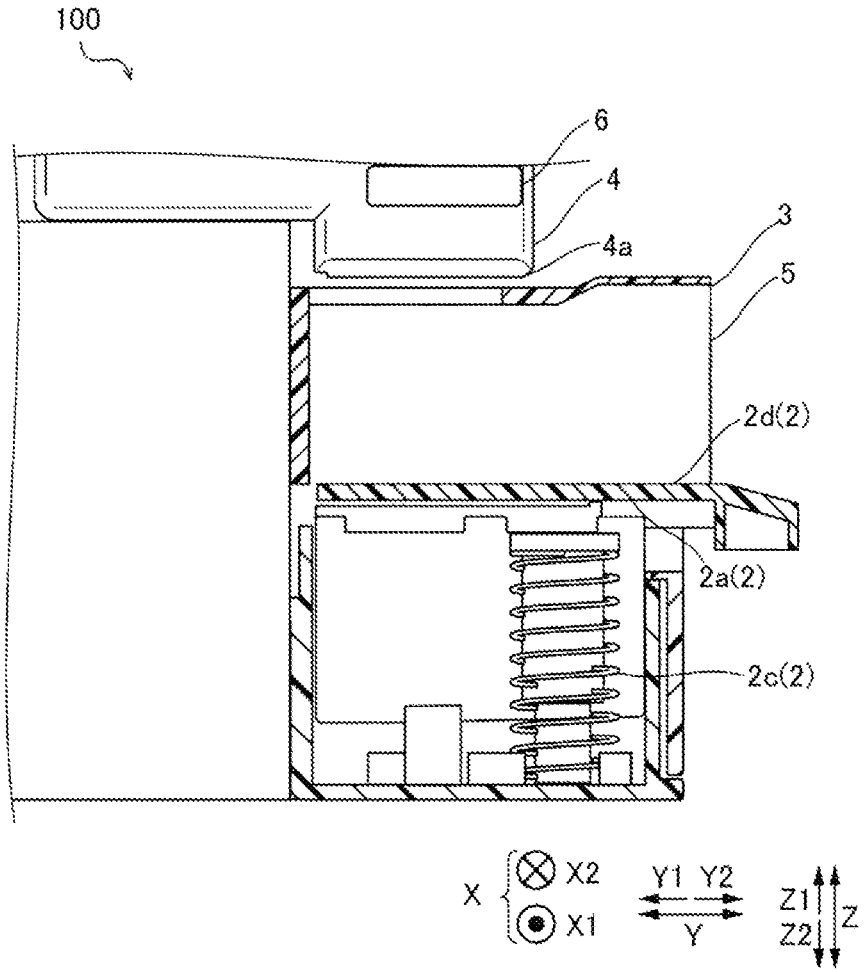
FIG. 3 is a partial cross-sectional view showing a state in which an interval between a placing unit and a positioning unit according to the first embodiment of the present disclosure is large.
Figure 4:
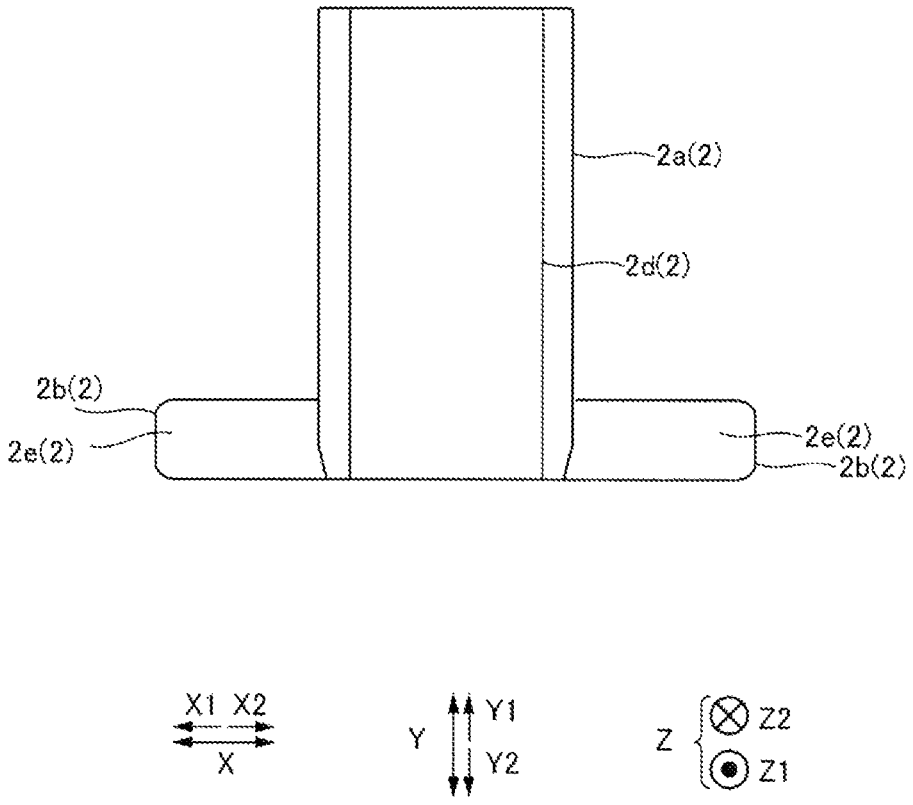
FIG. 4 is a view showing the placing unit according to the first embodiment of the present disclosure.

As shown in FIGS. 3 and 4, the placing unit 2 includes a placing table 2*a* extending from the inside (Y1 side) of the device main body 1 to the outside (Y2 side) of the device main body 1 via the insertion port 5 (extending in the Y2 direction), an extension portion 2*b* provided to protrude in a lateral direction of the placing table 2*a*, and a biasing member 2*c* which biases the placing table 2*a* toward the positioning unit 3.

As shown in FIG. 4, the placing table 2*a* has a placing surface 2*d* extending in the Y direction. Although not particularly limited, a length of the placing surface 2*d* in the X direction is determined in consideration of the fact that every person has a different width of fingers and the thumb and the little finger have different widths. The placing surface 2*d* is formed, for example, in a concave shape to conform to a shape of a lower surface of a finger in order to facilitate fixing of the finger inserted into the insertion port 5 (hereinafter also referred to as a printing target finger). Here, an upper surface of the finger means a surface on a nail side (the back side of the finger), and the lower surface of the finger means a surface opposite to the upper surface.

The placing table 2*a* can move in the Z direction, but is configured not to move in the X direction and the Y direction. In addition, in the first embodiment, the finger nail printer 100 is configured such that the placing table 2*a* moves in the Z direction in conjunction with the extension portion 2*b*.

As shown in FIG. 4, the extension portions 2*b* are provided outside the device main body 1 and are provided to protrude in the X direction from an outer (Y2 side) end portion of the placing table 2*a*. The extension portions 2*b* have placing regions 2*e* for placing fingers other than the finger inserted into the insertion port 5 on upper surfaces thereof (surfaces on the Z1 side). Also, the extension portions 2*b* have the mounting regions 2*e* on both sides (the X1 side and the X2 side) of the placing table 2*a*. Although the placing region 2*e* is shown as a flat surface in FIG. 4, the placing region 2*e* may be formed in a concave shape like the placing surface 2*d*.

The mounting regions 2*e* have lengths in the X direction that are equal to or greater than a length of the placing surface 2*d* of the placing table 2*a* in the X direction. Also, the lengths of the mounting regions 2*e* provided on both sides may differ between the X1 side and the X2 side, or may be the same.

The placement regions 2*e* are used to place fingers other than the printing target finger when a pattern is printed on a nail of the user. By placing a plurality of fingers other than the printing target in the placement regions 2*e*, the user can easily stabilize the printing target finger. Also, when the placement regions 2*e* are provided, the user may stabilize the printing target finger by bringing fingers other than the printing target finger into contact with lower surfaces of the extension portions 2*b* and sandwiching the extension portions 2*b* between the printing target finger and other fingers.

The placement regions 2*e* are also used for pressing the extension portions 2*b*. The user may use fingers of the same hand having the printing target finger which have been placed on the placement region 2*e*, or may press it with the other hand. For example, in a case of printing a pattern on a nail of the first finger of a right hand, the middle finger and the ring finger may be placed on the placement region 2*e* on the X2 side to press the extension portion 2*b* with the middle finger and the ring finger, or the extension portion 2*b* protruding to the X1 side may be pressed with a left hand.

A stopper may be provided to maintain a state in which the biasing member 2*c* is compressed as shown in FIG. 3. By providing the stopper, movement of the placing table 2*a* upward from a position where the stopper is provided can be restricted. In this case, the stopper is configured to be released when the user presses the placing table 2*a* or the extension portions 2*b* downward. The stopper includes a cam attached to a back side (the Y2 direction side) of the placing table 2*a* and a protruding portion to which the cam provided inside the device main body 1 is fitted. In this case, the cam rotates by pressing the placing table 2*a* downward (in the Z2 direction) and the placing table 2*a* is fixed when the cam is fitted to the protruding portion, whereby the biasing member 2*c* is maintained in a contracted state.

Figure 5:
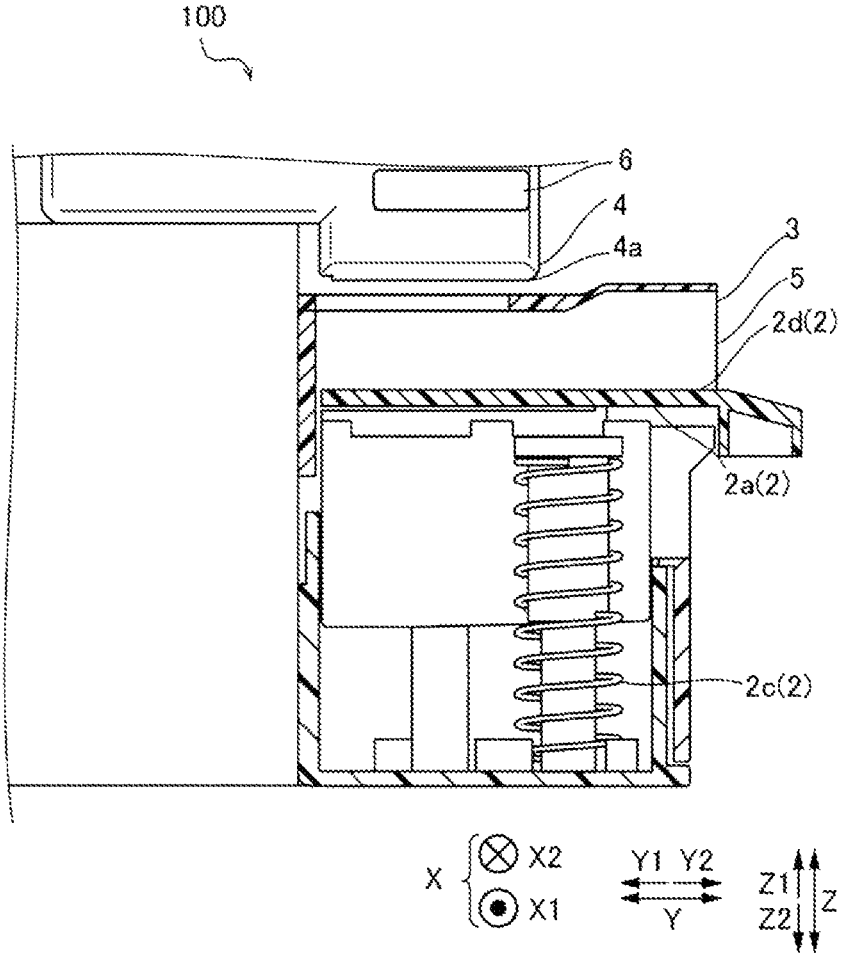
FIG. 5 is a partial cross-sectional view showing a state in which the interval between the placing unit and the positioning unit according to the first embodiment of the present disclosure is small.

As shown in FIG. 5, when an interval between the placing table 2*a* and the positioning unit 3 is small, the user presses and moves the placing table 2*a* downward (Z2 direction), thereby moving the placing table 2*a* downward against the biasing force of the biasing member 2*c*. As a result, as shown in FIG. 3, the interval of the insertion port 5 formed between the placing table 2*a* and the positioning unit 3 in the Z direction increases, so that the finger can be inserted and removed. The biasing force is a force that pushes up in the Z1 direction, and the placing table 2*a* is pushed up in a direction toward the positioning unit 3 with the biasing force, whereby the user's finger placed on the placing table 2*a* is pressed in the direction toward the positioning unit 3 and the finger is fixed.

As shown in FIG. 5, the positioning unit 3 is provided above the placing unit 2 (in the Z1 direction). As described above, the insertion port 5 is formed between the positioning unit 3 and the placing unit 2. For this reason, a shape of the positioning unit 3 is formed, for example, in a convex arc shape to conform to the upper surface of the finger.

As shown in FIG. 5, the printer head 4 has a nozzle 4*a* that discharges ink to the nail of the finger placed on the placing table 2*a*. The printer head 4 prints a pattern while being moved in the X direction and the Y direction, for example, by using a horizontal moving mechanism. In addition, the printer head 4 ejects ink from the nozzle 4*a* and prints a pattern on the nail. The ink is formed, for example, by appropriately combining three colors of red, blue and green and is ejected from the nozzle 4*a*. For example, by using an aqueous ink, the ink can be easily removed when the ink has adhered to the finger.

The printer head 4 moves to a position facing the placing table 2*a* when a pattern is printed on the nail using the horizontal moving mechanism, and, at other times, moves to a standby place so as not to come into contact with the finger when the finger is inserted.

As shown in FIG. 5, the finger nail printer 100 further includes an imaging unit 6. The imaging unit 6 is configured to be provided above the placing unit 2 (on the Z1 direction side) to capture an image of the upper surface of the finger placed on the placing unit 2. At this time, a mirror may be provided on a side surface side of the placing table 2*a*, and a side surface of the finger may also be captured by capturing a mirror image thereof.

Next, a method of using the finger nail printer 100 in the first embodiment will be described below.

A user inserts his or her finger into the insertion port 5 while pressing the placing table 2*a* in the state shown in FIG. 5 downward (in the Z2 direction). When the user weakens the force pressing the placing table 2*a* downward, the finger is fixed by the biasing member 2*c* extending such that a biasing force acts on the placing table 2*a*. At this time, the finger nail printer 100 captures an image of the finger placed on the placing table 2*a* using the imaging unit 6 and displays it on an external terminal or the like. The user adjusts a position of the finger placed on the placing table 2*a* on the basis of the displayed image of the finger.

Next, the user selects a pattern to be printed on his or her nail. The pattern is selected, for example, such that patterns are displayed on the terminal connected to the finger nail printer 100 and the user selects the pattern.

When the pattern is selected, the printer head 4 operates to print the pattern on the user's nail. When the printer head 4 completes the printing of the pattern on the nail, the user presses the placing table 2*a* or the extension portions 2*b* downward. As a result, as shown in FIG. 3, the biasing member 2*c* is contracted to form an interval between the placing table 2*a* and the positioning unit 3, and the state in which the finger is fixed is released. Thus the nail printing is completed.

Effects of the First Embodiment

In the first embodiment, the following effects can be obtained.

In the first embodiment, as described above, the finger nail printer 100 includes the placing unit 2 and the positioning unit 3, the placing unit 2 includes the placing table 2*a*, the extension portions 2*b*, and the biasing member 2*c*, and is configured such that the finger is fixed between the placing table 2*a* and the positioning unit 3 with the biasing force of the biasing member 2*c*, and the finger can be inserted and removed as the extension portions 2*b* are pressed downward against the biasing force of the biasing member 2*c*. By configuring this way, when removing the finger fixed between the placing unit 2 and the positioning unit 3, the user can release the fixed state of the finger by pressing the extension portions 2*b* downward against the biasing force of the biasing member 2*c* using a finger other than the fixed finger. As a result, even a child or a weak woman can easily press the placing table 2*a* downward against the biasing force.

Also, in the first embodiment, as described above, the upper surfaces of the extension portions 2*b* include the placement regions 2*e* in which fingers other than the finger inserted into the insertion port 5 can be placed. In this way, since fingers other than the finger inserted into the insertion port 5 can be placed in the placement regions 2*e*, the finger inserted into the insertion port 5 can be supported with other fingers placed on the placement regions 2*e*. For this reason, the finger inserted into the insertion port 5 can be stabilized.

Also, in the first embodiment, as described above, the placing regions 2*e* are provided on both sides of the placing table 2*a*. In this way, when the extension portions 2*b* are pressed against the biasing force of the biasing member 2*c* using a finger of another hand which is different from the finger fixed to the insertion port 5, the extension portion 2*b* provided on a side convenient for the user can be used. As a result, when the user presses the extension portions 2*b*, it is possible to prevent the user's arms from crossing, so that the extension portions 2*b* can be easily pressed.

Also, in the first embodiment, as described above, the placement regions 2*e* have lengths in the lateral direction equal to or longer than a length of the placing surface 2*d* of the placing table 2*a* in the lateral direction. In this way, one finger can be placed on the placing table 2*a*, while a plurality of fingers can be placed in the mounting regions 2*e*. For this reason, since the extension portions 2*b* can be easily pressed using a plurality of fingers, even a child or a weak woman can more easily press the extension portions 2*b* against the biasing force of the biasing member 2*c*.

Second Embodiment

Next, a second embodiment will be described with reference to FIGS. 1, 6 and 7. In a finger nail printer 200 of the second embodiment, in addition to the configuration of the finger nail printer 100 of the first embodiment, extension portions 22*b* are configured to be extendable and contractible. Also, the same components as those of the finger nail printer 100 according to the first embodiment are denoted by the same reference signs, and the description thereon will be omitted.

Figure 6:
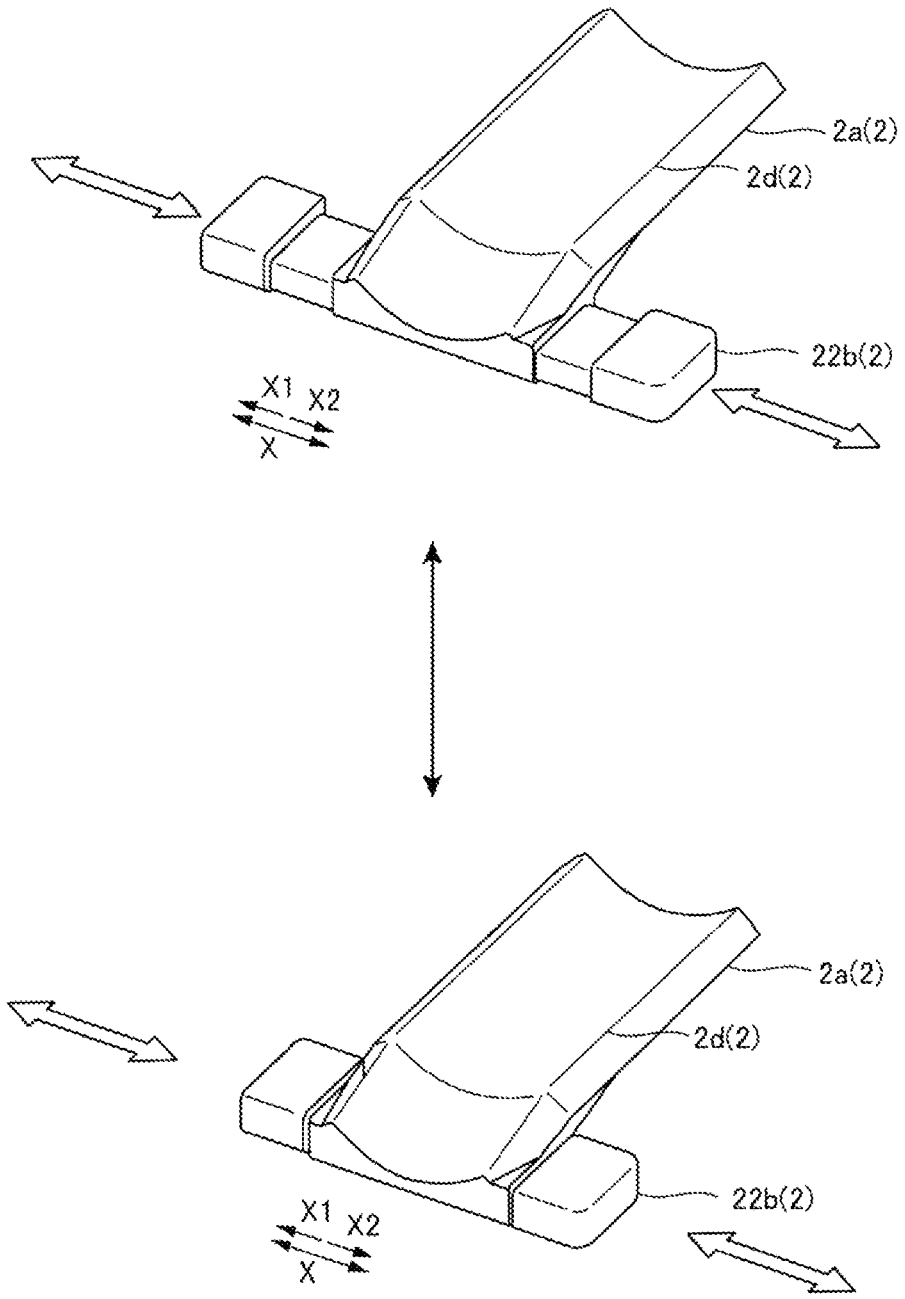
FIG. 6 is a view showing an extension portion according to a second embodiment of the present disclosure.

For example, as shown in FIG. 6, the extension portions 22*b* are provided to be extendable and contractible in the lateral direction (X direction) of the placing table 2*a*. Thus, a user can adjust the extension portions 22*b* to be lengths corresponding to widths of his or her fingers when placing fingers other than the printing target finger on the placement regions 2*e* of the extension portions 22*b*. In addition, the lengths of the extension portions 22*b* on both sides can also be adjusted using the finger placed in the placing table 2*a*. For example, when the printing target finger is a ring finger, the extension portion 22*b* on the little finger side is set to be shorter, and the extension portion 22*b* on the middle finger side is set to be longer in order to place the middle finger and the first finger thereon.

Figure 7:
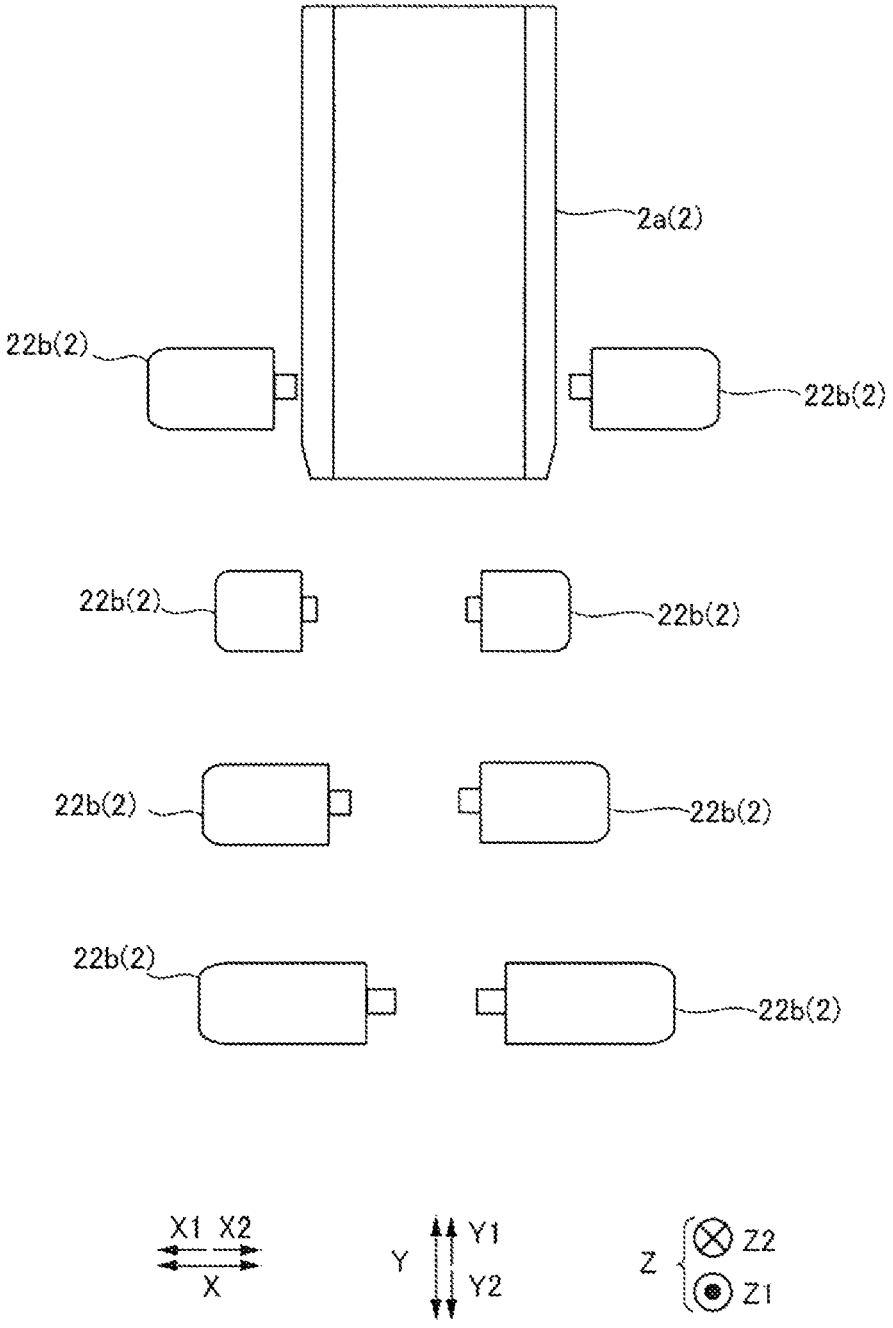
FIG. 7 is a view showing a plurality of extension portions having different lengths according to the second embodiment of the present disclosure.

Further, in an example of FIG. 7, the finger nail printer 200 in the second embodiment has a plurality of extension portions 22*b* having different lengths in the X direction. Each of the plurality of extension portions 22*b* having different lengths in the lateral direction (X direction) is removably attached to the placing table 2*a*. For example, screw locking may be performed by providing screw portions in the extension portions 22*b* and providing screw holes on sides of the placing table 2*a*. The user can adjust lengths of the extension portions 22*b* by preparing the plurality of extension portions 22*b* having different lengths in the X direction.

The remaining configuration of the second embodiment is the same as that of the first embodiment mentioned above.

Effects of the Second Embodiment

In the second embodiment, the following effects can be obtained.

In the second embodiment, as described above, the extension portions 22*b* are configured to be extendable and contractible in the lateral direction of the placing table 2*a*. In this way, the extension portions 22*b* can be adjusted to be lengths corresponding to sizes of the user's fingers by extending and contracting the extension portions 22*b* in the lateral direction.

In the second embodiment, as described above, the plurality of extension portions 22*b* having different lengths in the lateral direction are included, and each of the extension portions 22*b* is configured to be removably attached to the placing table 2*a*. In this way, it is possible to select the extension portions 22*b* having lengths corresponding to sizes of the user's fingers.

The other effects of the second embodiment are the same as those of the first embodiment.

Third Embodiment

Next, a third embodiment will be described with reference to FIGS. 1, 8 and 9. A finger nail printer 300 according to the third embodiment includes an adjustment drive mechanism 7 and a sensor 8. Also, the same components as those of the first embodiment are denoted by the same reference signs and the description thereon will be omitted.

Figure 8:
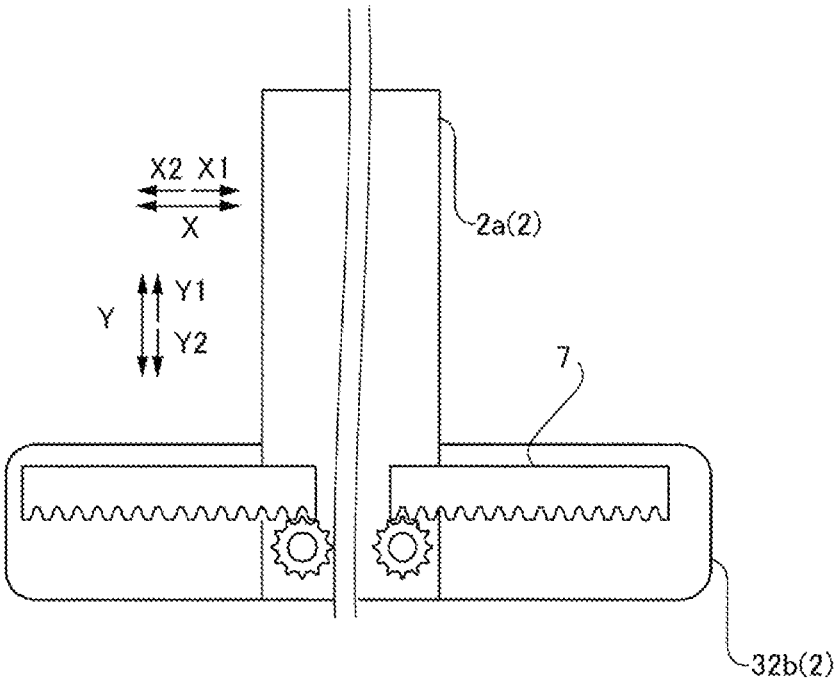
FIG. 8 is a view showing a drive adjustment mechanism according to a third embodiment of the present disclosure.

As shown in FIG. 8, unlike the finger nail printer 200 of the second embodiment, the finger nail printer 300 of the third embodiment has the adjustment drive mechanism 7. The adjustment drive mechanism 7 adjusts lengths of extension portions 32*b* by moving the extension portions 32*b* in the lateral direction (X direction). The adjustment drive mechanism 7 has a motor. For example, the adjustment drive mechanism 7 is configured by a rack and pinion mechanism, and the pinion is rotated by the motor.

Figure 9:
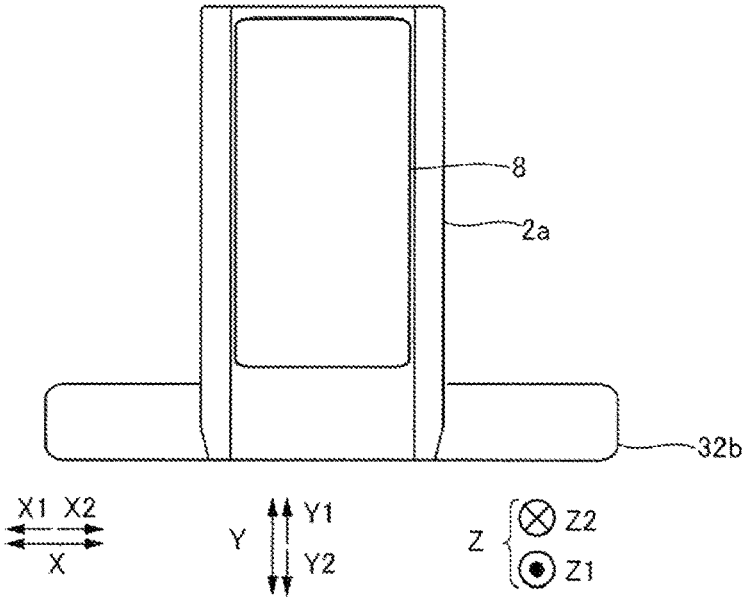
FIG. 9 is a view showing a placing unit according to a third embodiment or a fourth embodiment of the present disclosure.

As shown in FIG. 9, the sensor 8 is provided in the placing table 2*a*. The sensor 8 is a sheet-shaped tactile sensor. The sensor 8 detects a pressure of the finger placed on the placing table 2*a*, and detects a size (a size and a length) of the finger. Also, although the sensor 8 is exaggeratedly shown in FIG. 9, a shape and a size (lengths in the Y direction and the X direction) of the sensor 8 are not particularly limited as long as they can match fingers of various sizes.

The adjustment drive mechanism 7 is configured to adjust the lengths of the extension portions 32*b* on the basis of results detected by the sensor 8. For example, when the sensor 8 detects that the little finger is placed on the placing table 2*a*, in order to stabilize the printing target finger, the finger nail printer 300 uses the adjustment drive mechanism 7 to lengthen the length of the extension portion 32*b* so that the ring finger and the middle finger can be placed thereon.

The remaining configuration of the third embodiment is the same as that of the first embodiment mentioned above.

Effects of the Third Embodiment

In the third embodiment, the following effects can be obtained.

In the third embodiment, as described above, the adjustment drive mechanism 7 which adjusts the lengths of the extension portions 32*b* by moving the extension portions 32*b* in the lateral direction is further provided. In this way, since the lengths of the extension portions 32*b* are automatically adjusted by the adjustment drive mechanism 7, there is no need for the user to adjust the lengths of the extension portions 32*b*.

In the third embodiment, the placing table 2*a* includes the sensor 8 for detecting information on the size of the finger, and the adjustment drive mechanism 7 is configured to adjust the lengths of the extension portions 32*b* on the basis of the results detected by the sensor 8. In this way, since the adjustment drive mechanism 7 automatically adjusts the lengths of the extension portions 32*b* on the basis of the information on the size of the finger detected by the sensor 8, the extension portions 32*b* can be automatically adjusted to the lengths corresponding to the size of the user's finger.

The other effects of the third embodiment are the same as those of the first embodiment.

Fourth Embodiment

Next, a fourth embodiment will be described with reference to FIGS. 1, 9 and 10. A finger nail printer 400 of the fourth embodiment includes the sensor 8 and a control unit 9 in addition to the configuration of the first embodiment. Also, the same components as those of the first embodiment are denoted by the same reference signs and the description thereon will be omitted.

As shown in FIG. 9, the sensor 8 is provided on the placing table 2*a*. The sensor 8 is a tactile sensor. The sensor 8 detects a pressure of the finger placed on the placing table 2*a*, and detects a size (a size and a length) of the finger. Also, although the sensor 8 is exaggeratedly shown in FIG. 9, a shape and a size (lengths in the Y direction and the X direction) of the sensor 8 are not particularly limited as long as they can match fingers of various sizes.

Figure 10:
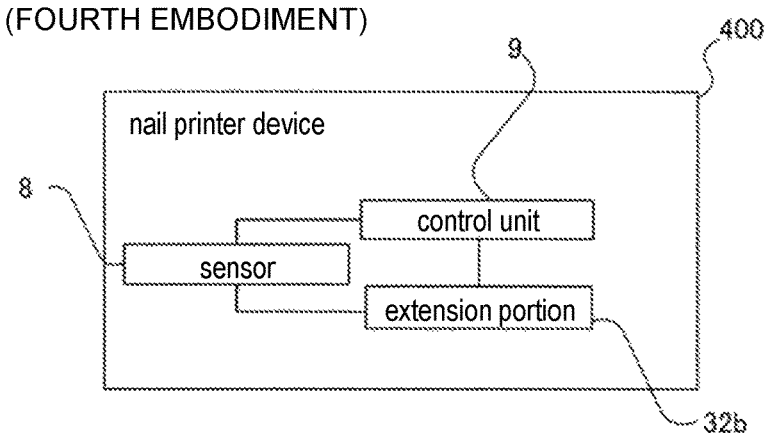
FIG. 10 is a block diagram of a finger nail printer according to a fourth embodiment of the present disclosure.

As shown in FIG. 10, the finger nail printer 400 includes the control unit 9. The control unit 9 is, for example, a central processing unit (CPU).

The control unit 9 is configured to output information on the lengths of the extension portions 32*b* on the basis of the results detected by the sensor 8. For example, when the sensor 8 detects that the printing target finger is the little finger, in order to stabilize the printing target finger, the control unit 9 outputs information to increase the length of the extension portion 32*b* so that the ring finger and the middle finger can be placed thereon. Also, for example, when the printing target finger is the little finger, the control unit 9 outputs information such as to lengthen the length of the extension portion 32*b* on one side, not the extension portions 32*b* on both sides. An output destination is, for example, an external terminal owned by the user. The user adjusts the lengths of the extension portions 32*b* on the basis of the output information.

The remaining configuration of the fourth embodiment is the same as that of the first embodiment mentioned above.

Effects of the Fourth Embodiment

In the fourth embodiment, the following effects can be obtained.

In the fourth embodiment, as described above, the control unit 9 is further provided, the placing table 2*a* includes the sensor 8 for detecting information on the size of the finger, and the control unit 9 is configured to output information on the lengths of the extension portions 32*b* on the basis of the results detected by the sensor 8. In this way, since the information on optimal lengths of the extension portions 32*b* is output on the basis of the information on the size of the finger detected by the sensor 8, the extension portions 32*b* can be adjusted to be optimal lengths corresponding to sizes of the user's fingers.

In the fourth embodiment, as described above, the sensor 8 is a tactile sensor. According to this configuration, by detecting the pressure or the like, it is possible to accurately acquire information on the size of the finger placed on the placing table 2*a*.

The other effects of the fourth embodiment are the same as those of the first embodiment mentioned above.

Fifth Embodiment

Figure 11:
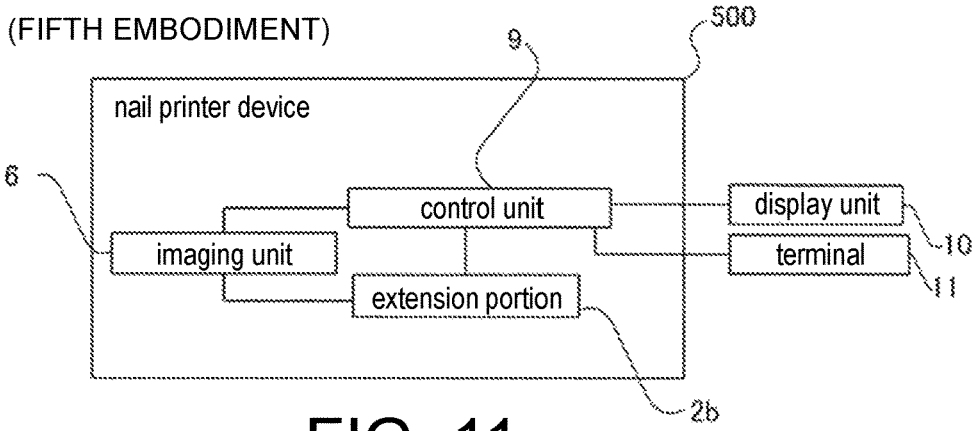
FIG. 11 is a block diagram of a finger nail printer according to a fifth embodiment of the present disclosure.

Next, a fifth embodiment will be described with reference to FIGS. 1 and 11. A finger nail printer 500 of the fifth embodiment further includes the control unit 9 in addition to the configuration of the first embodiment. Also, the same components as those of the first embodiment are denoted by the same reference signs, and the description thereon will be omitted.

The imaging unit 6 is configured to capture an image of the upper surface of the finger placed on the placing unit 2. In addition, the imaging unit 6 can move and change an angle of view to image the extension portions 2*b*.

Figure 12:
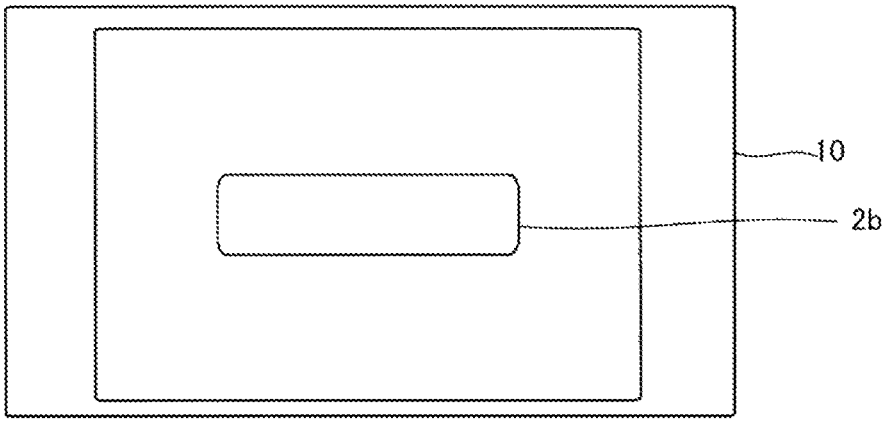
FIG. 12 is an example of display on a display unit according to a fifth embodiment of the present disclosure.

The control unit 9 performs control to display the image captured by the imaging unit 6 on a display unit 10 or an external terminal 11. As shown in FIG. 12, the image captured by the imaging unit 6 is output to the display unit 10 or the external terminal 11. For example, the display unit 10 may be a monitor of the device main body 1 or a monitor connected to the device main body 1. The external terminal 11 may be a screen of a smartphone, a screen of a mobile phone, or a screen of a personal computer, which are owned by the user. In addition, a display for selecting a pattern to be printed on the nail may be performed on the display unit 10 and the external terminal 11.

The control unit 9 performs control to output information on the lengths of the extension portions 2*b*. The control unit 9 causes the display unit 10 to display information on the lengths of the extension portions 2*b* on the basis of the images of the upper surface of the finger and the lengths of the extension portions 2*b* captured by the imaging unit 6. For example, when the little finger is placed on the placing table 2*a*, in order to stabilize the printing target finger, information to increase the length of the extension portions 2*b* is displayed so that the ring finger and the middle finger can be placed thereon. As a result, the user adjusts the lengths of the extension portions 2*b* on the basis of the displayed information.

The remaining configuration of the fifth embodiment is the same as that of the first embodiment mentioned above.

Effects of the Fifth Embodiment

In the fifth embodiment, the following effects can be obtained.

In the fifth embodiment, as described above, the imaging unit 6 disposed above the placing unit 2, and the control unit 9 which outputs the image of the upper surface captured by the imaging unit 6 to the display unit 10 or the external terminal 11 are further provided, the imaging unit 6 captures the image of the extension portions 2*b* in addition to a nail portion of the finger, and the control unit 9 is configured to output information on the lengths of the extension portions 2*b* on the basis of results obtained from the imaging of the extension portions 2*b* by the imaging unit 6. In this way, since information on the lengths of the extension portions 2*b* is displayed on the display unit 10 or the external terminal 11, the user can adjust the extension portions 2*b* to be optimal lengths of the extension portions 2*b* on the basis of the displayed information.

The other effects of the fifth embodiment are the same as those of the first embodiment mentioned above.

MODIFIED EXAMPLES

Also, it should be understood that the embodiments described herein are exemplary and are not to be considered as limiting in every respect. The scope of the present disclosure is indicated not by the description of the embodiments described above but by the claims, and further includes all modifications (modified examples) within the meaning and scope equivalent to the claims.

For example, in the first embodiment, although the example in which the placement regions have lengths in the lateral direction (X direction) equal to or greater than the length of the placing surface of the placing table in the lateral direction (X direction) has been described, the disclosure is not limited thereto. In the present disclosure, the placing regions may have lengths in the lateral direction (X direction) shorter than the length of the placing surface of the placing table in the lateral direction (X direction).

Also, in the first embodiment, although the example in which the extension portions are provided on both sides of the placing table has been described, the present disclosure is not limited thereto. In the present disclosure, the extension portion may be provided on only one side.

Also, in the second embodiment, although the example in which a plurality of the extension portions are screwed and locked at the side of the placing table has been described, the present disclosure is not limited thereto. In the present disclosure, for example, a pin may be provided in the extension portion, inserted into the placing table, and then fixed as a tip of the pin is expanded.

Also, in the third and fourth embodiments, although the example in which the sensor is a tactile sensor has been described, the present disclosure is not limited thereto. In the present disclosure, any sensor may be used as long as it can detect information on a size of a finger.

Also, in the third and fourth embodiments, although the example in which the sensor detects the information on the size of the finger has been described, the present disclosure is not limited thereto. In the present disclosure, the control unit may detect the information on the size of the finger from the image of the finger captured by the imaging unit.

Also, in the third embodiment, although the example in which the adjustment drive unit is configured of the rack and pinion mechanism, the present disclosure is not limited thereto. In the present disclosure, it may be configured of a belt and pulley mechanism.

Also, in the fourth embodiment, although the example in which the information on the lengths of the extension portions is output on the basis of the results detected by the sensor has been described, the present disclosure is not limited thereto. The present disclosure may be used for other purposes on the basis of the results detected by the sensor. For example, whether the printing target finger is an adult's finger or a child's finger may be detected, and the control unit may be designed to change an order of displaying types of a pattern to be selected.

Also, in the fifth embodiment, although the example in which the imaging unit captures the image of the upper surface of the finger and the image of the extension portions, the present disclosure is not limited thereto. In the present disclosure, the upper surface of the finger and the extending portions may be imaged by providing a plurality of imaging units.

What is claimed is:

1. A finger nail printer comprising:

a device main body;

a placing unit for placing a finger;

a positioning unit which is provided above the placing unit to constitute an insertion port for inserting a finger between the placing unit and the positioning unit and to fix the finger; and a printer head which performs printing on a nail of the finger placed on the placing unit, wherein the placing unit comprises a placing table extending from an inside of the device main body to an outside of the device main body via the insertion port, at least one extension portion provided to protrude in a lateral direction of the placing table, and a biasing member for biasing the placing table toward the positioning unit, and is configured such that the finger is fixed between the placing table and the positioning unit with a biasing force of the biasing member and the finger is capable of being inserted into or removed from the insertion port as the extension portion is pressed downward against the biasing force of the biasing member.

2. The finger nail printer according to claim 1, wherein the extension portion comprises a placing region, in which the finger at a place other than being inserted into the insertion port can be placed, on an upper surface of the extension portion.

3. The finger nail printer according to claim 2, wherein the placing region is provided on both sides of the placing table.

4. The finger nail printer according to claim 3, wherein the placing region has a length in the lateral direction equal to or longer than a length of a placing surface of the placing table in the lateral direction.

5. The finger nail printer according to claim 4, wherein the at least one extension portions comprises a plurality of the extension portions having different lengths in the lateral direction, and each of the extension portions is configured to be removably attached to the placing table.

6. The finger nail printer according to claim 3, wherein the extension portion is configured to be extendable and contractible in the lateral direction of the placing table.

7. The finger nail printer according to claim 6, wherein the sensor is a tactile sensor.

8. The finger nail printer according to claim 3, wherein the at least one extension portions comprises a plurality of the extension portions having different lengths in the lateral direction, and each of the extension portions is configured to be removably attached to the placing table.

9. The finger nail printer according to claim 2, wherein the placing region has a length in the lateral direction equal to or longer than a length of a placing surface of the placing table in the lateral direction.

10. The finger nail printer according to claim 9, wherein the extension portion is configured to be extendable and contractible in the lateral direction of the placing table.

11. The finger nail printer according to claim 9, wherein the at least one extension portions comprises a plurality of the extension portions having different lengths in the lateral direction, and each of the extension portions is configured to be removably attached to the placing table.

12. The finger nail printer according to claim 2, wherein the extension portion is configured to be extendable and contractible in the lateral direction of the placing table.

13. The finger nail printer according to claim 2, wherein the at least one extension portions comprises a plurality of the extension portions having different lengths in the lateral direction, and each of the extension portions is configured to be removably attached to the placing table.

14. The finger nail printer according to claim 2, further comprising:

an adjustment drive mechanism which adjusts a length of the extension portion by moving the extension portion in the lateral direction.

15. The finger nail printer according to claim 1, wherein the extension portion is configured to be extendable and contractible in the lateral direction of the placing table.

16. The finger nail printer according to claim 1, wherein the at least one extension portions comprises a plurality of the extension portions having different lengths in the lateral direction, and each of the extension portions is configured to be removably attached to the placing table.

17. The finger nail printer according to claim 1, further comprising:

an adjustment drive mechanism which adjusts a length of the extension portion by moving the extension portion in the lateral direction.

18. The finger nail printer according to claim 17, wherein the placing table comprises a sensor which detects information on a size of the finger, and the adjustment drive mechanism is configured to adjust the length of the extension portion on the basis of results detected by the sensor.

19. The finger nail printer according to claim 1, further comprising:

a control unit, wherein the placing table comprises a sensor for detecting information on a size of the finger, and the control unit is configured to output information on a length of the extension portion on the basis of results detected by the sensor.

20. The finger nail printer according to claim 1, further comprising:

an imaging unit disposed above the placing unit; and a control unit which outputs an image of an upper surface captured by the imaging unit to a display unit or an external terminal, wherein the imaging unit images the extension portion in addition to a nail portion of the finger, and the control unit is configured to output information on a length of the extension portion on the basis of results obtained from imaging the extension portion by the imaging unit.

* * * * *